US009033656B2

(12) United States Patent
Mizumi et al.

(10) Patent No.: US 9,033,656 B2
(45) Date of Patent: May 19, 2015

(54) EXHAUST SYSTEM FOR STEAM TURBINE

(75) Inventors: Shunsuke Mizumi, Hitachinaka (JP); Koji Ogata, Mito (JP); Takeshi Kudo, Hitachinaka (JP); Noriyo Nishijima, Abiko (JP); Yoshiaki Onda, Mito (JP)

(73) Assignee: Mitsubishi Hitachi Power Systems, Ltd., Kanagawa (JP)

( * ) Notice: Subject to any disclaimer, the term of this patent is extended or adjusted under 35 U.S.C. 154(b) by 703 days.

(21) Appl. No.: 13/343,180

(22) Filed: Jan. 4, 2012

(65) Prior Publication Data

US 2012/0183397 A1 Jul. 19, 2012

(30) Foreign Application Priority Data

Jan. 14, 2011 (JP) ..... 2011-006088

(51) Int. Cl.
*F01D 25/24* (2006.01)
*F01D 25/30* (2006.01)

(52) U.S. Cl.
CPC ..... *F01D 25/30* (2013.01); *F01D 25/24* (2013.01); *F05D 2250/52* (2013.01); *F05D 2250/73* (2013.01)

(58) Field of Classification Search
CPC ..... F01D 25/24; F01D 25/30; F05D 2250/52; F05D 2250/70; F05D 2250/73
USPC ..... 415/207, 211.2, 220, 224.5, 225, 226, 415/914
See application file for complete search history.

(56) References Cited

U.S. PATENT DOCUMENTS 2,641,442 A 6/1953 Buechi
3,630,635 A * 12/1971 Fatum ..... 415/214.1
(Continued)

FOREIGN PATENT DOCUMENTS

CH 243 667 A 7/1946
EP 0 959 231 A1 11/1999
(Continued)

OTHER PUBLICATIONS

Japanese Office Action with English Translation dated Nov. 26, 2013 (six (6) pages).
(Continued)

*Primary Examiner* — Edward Look
*Assistant Examiner* — Christopher R Legendre
(74) *Attorney, Agent, or Firm* — Crowell & Moring LLP

(57) ABSTRACT

An exhaust system for a steam turbine provided with an improved annular flow guide in a high or intermediate turbine. The improved flow guide reduces flow turbulence in an exhaust hood and reduces pressure loss to thereby improve turbine plant efficiency.
The shape (vertically symmetric) of a flow guide 5A according to a conventional technology was modified into the shape (vertically asymmetric) of a flow guide 5 such that the length of a downstream flow guide portion 5*d* is greater than that of a upstream flow guide portion 5*u*. Numerical analyses were performed to find the optimum flow guide occupation ratio of the conventional technology and the corresponding total pressure loss coefficient. The obtained values were used as reference values. Further, the flow guide occupation ratio of the upstream flow guide portion 5*u* was set at 0.4 and the flow guide occupation ratio of the downstream flow guide portion 5*d* was set at 0.7; at values where the total pressure loss coefficient becomes lower than the reference value. The rectification effect of the flow guide can thus be enhanced.

3 Claims, 10 Drawing Sheets

(56) References Cited

U.S. PATENT DOCUMENTS

| | | | | | |
|---|---|---|---|---|---|
| 5,257,906 | A | | 11/1993 | Gray et al. | |
| 5,494,405 | A | * | 2/1996 | Gray et al. | 415/211.2 |
| 5,518,366 | A | * | 5/1996 | Gray | 415/226 |
| 2012/0183397 | A1 | * | 7/2012 | Mizumi et al. | 415/220 |

FOREIGN PATENT DOCUMENTS

| | | | | |
|---|---|---|---|---|
| FR | 2569766 | A1 | * | 3/1986 |
| JP | 59-60009 | A | | 4/1984 |
| JP | 6-66157 | A | | 3/1994 |
| JP | 08260904 | A | * | 10/1996 |
| JP | 11-200814 | A | | 7/1999 |
| JP | 2001-3710 | A | | 1/2001 |
| JP | 2005233154 | A | * | 9/2005 |
| JP | 3776580 | B2 | | 3/2006 |
| JP | 2006283587 | A | * | 10/2006 |
| JP | 2006329148 | A | * | 12/2006 |
| JP | 2007-40228 | A | | 2/2007 |
| JP | 2007-64190 | A | | 3/2007 |
| JP | 2007-303324 | A | | 11/2007 |
| JP | 2012067604 | A | * | 4/2012 |

OTHER PUBLICATIONS

Korean Office Action with English Translation dated Nov. 26, 2013 (twelve (12) pages).
European Search Report dated Mar. 7, 2014 (six (6) pages).

* cited by examiner

EXHAUST SYSTEM FOR STEAM TURBINE

BACKGROUND OF THE INVENTION

1. Field of the Invention

The present invention relates generally to a turbine exhaust system for a steam turbine that discharges from an exhaust duct the steam having passed through a turbine blade. In particular, the invention relates to an exhaust system for a high pressure or an intermediate pressure turbine.

2. Description of the Related Art

Electric generating plants generate electric power by rotating a turbine with steam produced by a steam generator such as a boiler. An electric generating plant generally includes a plurality of turbines adapted for different steam pressures; for example, a high pressure turbine, an intermediate turbine, and a low pressure turbine. After being passed through from the high pressure turbine to the low pressure turbine to finish rotating work, the steam is finally led into a condenser. The steam then condenses into condensed water and returns to the steam generator. The exit of each high, intermediate, and low pressure turbines is linked with a turbine exhaust system that guides steam to the subsequent stage equipment such as a lower pressure turbine, a condenser, etc. The turbine exhaust system includes an exhaust hood defined between an inner casing covering a turbine rotor and an outer casing further covering the inner casing. The steam that has passed through the turbine blade is delivered to the subsequent stages via the exhaust hood.

A common exhaust hood changes the direction of a steam flow delivered from a turbine from an axial-flow direction to a direction perpendicular thereto in a very short distance. Therefore, exhaust hoods tend to disturb the steam flow and cause pressure loss. In particular, exhaust hoods of high and intermediate pressure turbines have a shorter flow passage than those of low pressure turbines. Further, parts of high and intermediate pressure turbines are made thicker than those of low pressure turbines in order to withstand pressure. Exhaust hoods of high and intermediate pressure turbines are thus more likely to be affected by their inner components such as flanges compared to low pressure turbines.

An example of conventional technologies made in consideration of the above matters is disclosed in JP-2007-40228-A. According to the publication, an annular flow guide is provided at the leading end side of the exit portion of last stage rotor blades. The flow guide rectifies the flow and in turn reduces flow turbulence. The flow guide disclosed in JP-2007-40228-A is an annular flow guide constructed by combining a convexly curved flange with a disk-like steam guide. In contrast, flared annular flow guides are often used in real machines.

Incidentally, flow guides of a low pressure turbine serve as a diffuser for converting kinetic energy to pressure energy. In addition, exhaust hoods of low pressure turbines have less spatial restriction than those of high and intermediate pressure turbines. In regard of this, a flow guide having a vertically asymmetric shape (whose lower side is long) is proposed in the aim of improving diffuser effect (JP 3776580).

SUMMARY OF THE INVENTION

An exhaust hood of high and intermediate pressure turbines have more spatial restriction (size of flow passage, thickness of each component) than that of low pressure turbines. If an annular flow guide is excessively enlarged (elongated), the flow passage will be blocked to degrade performance. Most of the conventional flow guides of high and intermediate pressure turbines therefore have substantially identical cross-sectional shapes in a circumferential direction (vertically symmetric), and an idea of modifying this shape was unlikely to occur.

Since the exhaust hood of high and intermediate pressure turbines has a shorter axial distance than that of the low pressure turbine, it cannot provide a sufficient diffuser effect. Therefore, despite the fact that the flow guides of low pressure turbines have been suggested to have their shape modified in the conventional technology, an idea of applying it to high and intermediate pressure turbines was unlikely to occur.

Inventors of the present application put focus on this point and performed detailed three-dimensional analyses. The result of the analyses indicated the fact that an occupancy ratio of a flow guide to a passage space has a significant impact on the pressure loss reduction performance of the flow guide. Further, it was found that the conventional flow guides were not fully exhibiting the effect.

An object of the present invention is to provide an exhaust system of a steam turbine comprising an improved annular flow guide for high and/or intermediate turbines, whereby suppressing turbulence of a flow in an exhaust hood to reduce more pressure loss and improve turbine plant efficiency.

(1) A first aspect of the present invention is an exhaust system for a steam turbine that guides exhaust gas used to drive a high pressure turbine or an intermediate turbine to a downstream turbine via an exhaust duct, the system comprising: an exhaust hood inner casing enclosing a turbine rotor; an exhaust hood outer casing surrounding the exhaust hood inner casing to define an exhaust hood therebetween; and an annular flow guide installed downstream of last stage rotor blades which are fixed to the turbine rotor, the annular flow guide being installed continuously with an outer circumference of the exhaust hood inner casing; wherein the flow guide includes a downstream flow guide portion at the side of the exhaust duct and a upstream flow guide portion at the side opposite to the exhaust duct, the two portions being formed so that the downstream flow guide portion has a greater length than the upstream flow guide portion.

The exhaust hood downstream side has less spatial restriction than that of the exhaust hood upstream side since there is a joint portion with the exhaust duct. Therefore, a flow passage would not close even if the flow guide is elongated. The length of the downstream flow guide portion can be increased to enhance rectification effect of the flow guide.

(2) A second aspect of the present invention is the exhaust system for a steam turbine according to (1); wherein, when an imaginary line is drawn radially from the center of the rotor on a cross-section perpendicular to a rotor axis, the distance between a root portion of the flow guide and a leading end of the same is defined as a first distance, and the distance between the root portion of the flow guide and an inner wall surface of the exhaust hood outer casing is defined as a second distance, the ratio of the first distance to the second distance is defined as a flow guide occupancy ratio; and the flow guide is formed so that the downstream flow guide portion has a greater flow guide occupancy ratio than the upstream flow guide portion.

With the configuration described above, the rectification effect can be enhanced.

(3) A third aspect of the present invention is the exhaust system for a steam turbine according to (2); wherein a flow guide occupancy ratio between the downstream flow guide portion and the upstream flow guide portion is continuous.

If the flow guide occupancy ratio of the portion (interval) between the downstream flow guide portion and the upstream flow guide portion is discontinuous, the portion would have a projecting shape or the like, which interrupts a steam flow. Because of the continuity, such trouble can be prevented.

(4) A fourth aspect of the present invention is the exhaust system for a steam turbine according to (2); wherein the flow guide occupancy ratio of the downstream flow guide portion is between 0.6 and 0.7 inclusive; and the flow guide occupancy ratio of the upstream flow guide portion is between 0.3 and 0.6 inclusive.

A pressure loss can be more reduced compared with that of the conventional technology by setting the flow guide occupancy ratios as above.

(5) A fifth aspect of the present invention is the exhaust system for a steam turbine according to (4); wherein the flow guide occupancy ratio of the upstream flow guide portion is between 0.5 and 0.6 inclusive.

According to the present invention, an annular flow guide for high and/or intermediate turbines can be improved in performance to suppress flow turbulence in an exhaust hood and reduce more pressure loss, thereby increasing turbine plant efficiency.

DESCRIPTION OF THE PREFERRED EMBODIMENTS

First Embodiment

Configuration

Figure 1:
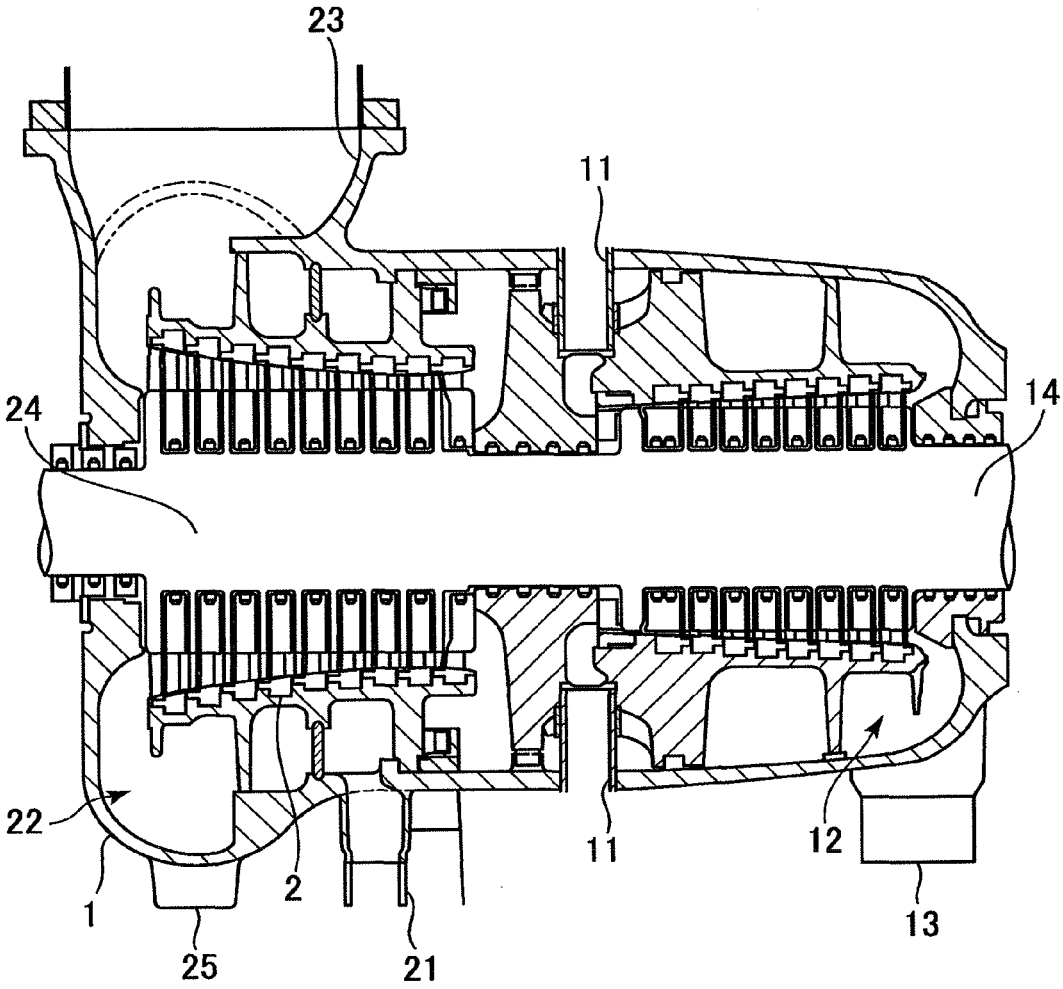
FIG. 1 is a cross-sectional view illustrating a schematic configuration of high pressure and intermediate pressure portions of a steam turbine.

FIG. 1 is a cross-sectional view illustrating a schematic configuration of high and intermediate pressure portions of a steam turbine embodying the present invention. Steam first flows in from a high pressure inlet 11, performs work in a high pressure turbine stage 14, and flows out into a high pressure exhaust duct 13 via a high pressure exhaust hood 12. The steam flowing out from the high pressure exhaust hood 12 flows through the high pressure exhaust duct 13, a boiler (not shown) and a reheat inlet duct 21 and enters an intermediate turbine stage 24. After doing work at the intermediate turbine stage 24, the steam flows out into an intermediate exhaust duct 23 via an intermediate exhaust hood 22. On the other hand, the steam bled thorough a bleed pipe is led into a heater to be heated.

An exhaust system includes an inner casing 2 covering a turbine rotor 3 of the steam turbine and an outer casing 1 covering the inner casing 2.

The high pressure exhaust hood 12 and the intermediate exhaust hood 22 are defined between the outer casing 1 and the inner casing 2. The following description will be made by taking the high pressure exhaust hood 12 as the subject; however, the same applies to the intermediate pressure exhaust hood 22.

Figure 2:
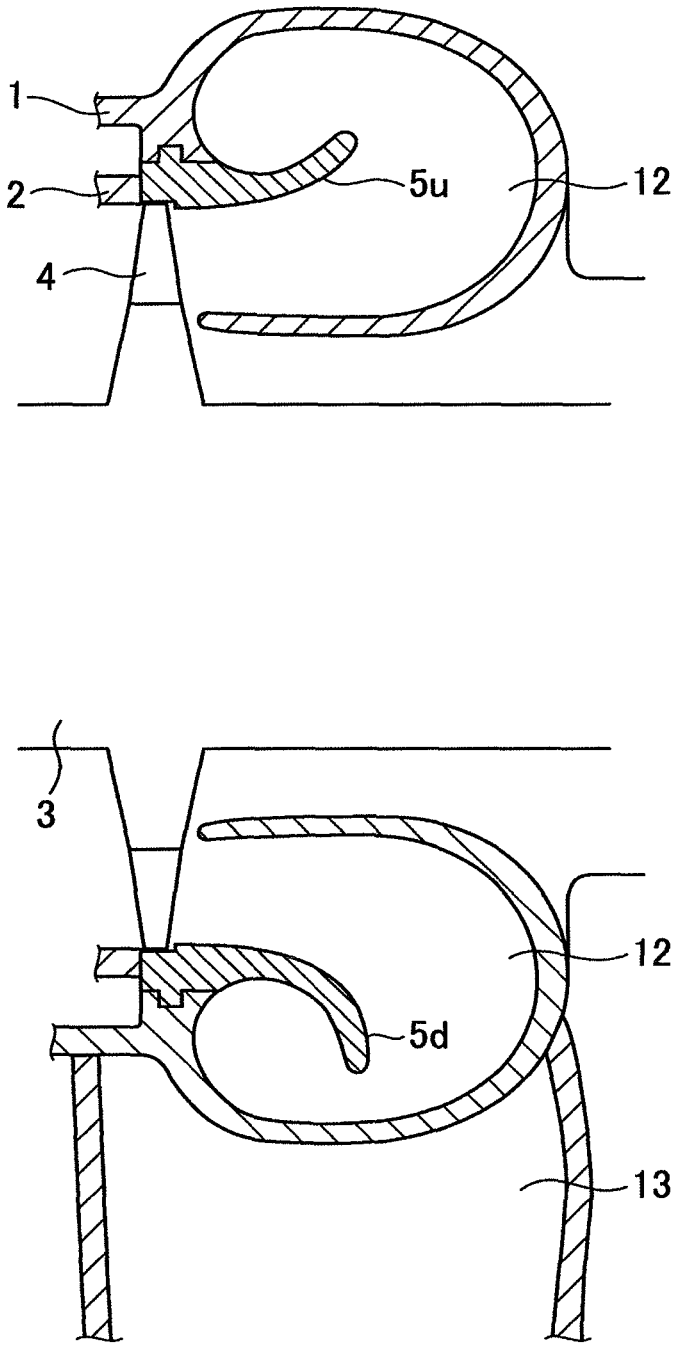
FIG. 2 is a longitudinal cross-sectional view illustrating a detailed configuration of an exhaust hood.
Figure 3:
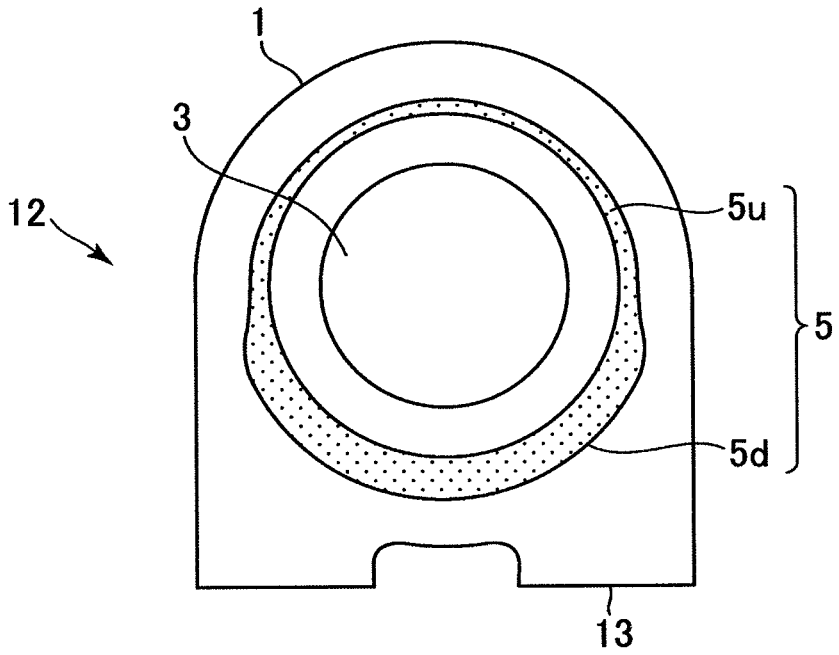
FIG. 3 is a transverse cross-sectional view illustrating the detailed configuration of the exhaust hood (first embodiment).

FIG. 2 is a longitudinal cross-sectional view illustrating a detailed configuration of the exhaust hood 12. FIG. 3 is a transverse cross-sectional view illustrating a detailed configuration of the exhaust hood 12.

The exhaust hood 12 leads the exhaust gas that has been used to drive the turbine rotor 3 into a downstream turbine by way of two exhaust ducts 13 disposed at the downstream of the exhaust hood 12. At the downstream side of last stage rotor blades 4 fixed to the turbine rotor 3, an annular flow guide 5 is installed continuously with the outer circumference of the inner casing 2. The aim for installing the flow guide 5 is to reduce pressure loss due to mixing of the steam exhausted from the turbine.

The flow guide 5 protrudes from a root portion connected to the inner casing 2 toward the downstream side and an axially-outward direction at a certain curvature, thus forming a flared shape.

The feature of the present embodiment resides in the shape of the flow guide 5. The flow guide 5 is formed so that the length of a downstream flow guide portion 5*d* positioning on the exhaust duct 13 side is greater than that of an upstream flow guide portion 5*u* positioning on the opposite side of the exhaust duct 13.

—Motion—

A steam flow flowing out from the last stage rotor blade 4 is guided by the flow guide 5. The steam flow led by the upstream flow guide portion 5*u* is delivered to the downstream along the inner wall surface of the outer casing 1 and into the exhaust duct 13. The steam flow led by the downstream flow guide portion 5*d* is guided into the exhaust duct 13. At this point, the downstream flow guide portion 5*d* prevents the mixing of the flow (rectification effect).

—Numerical Analysis—

The present inventor focused on the shape of the flow guide 5 and performed detailed numerical analysis (CFD analysis).

Figure 4:
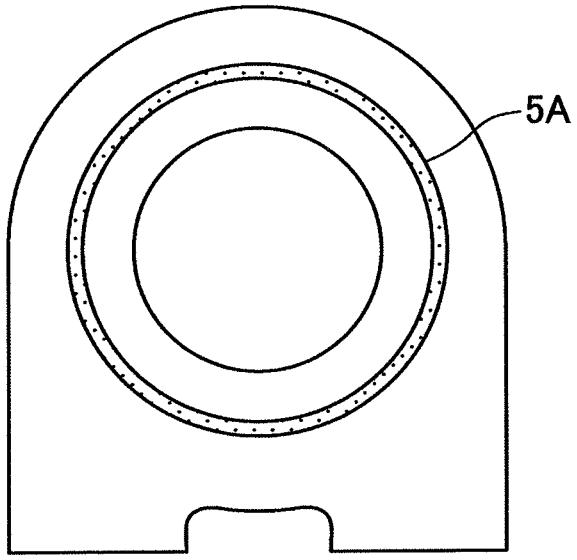
FIG. 4 CONVENTIONAL ART
FIG. 4 is a transverse cross-sectional view illustrating a detailed configuration of an exhaust hood (conventional technology).

FIG. 4 is a transverse cross-sectional view showing a detailed configuration of an exhaust hood 12 provided with a vertically symmetric flow guide 5A according to a conventional technology. First, the optimum size (length) of the flow guide 5A of the conventional technology was considered (analysis 1).

Figure 5:
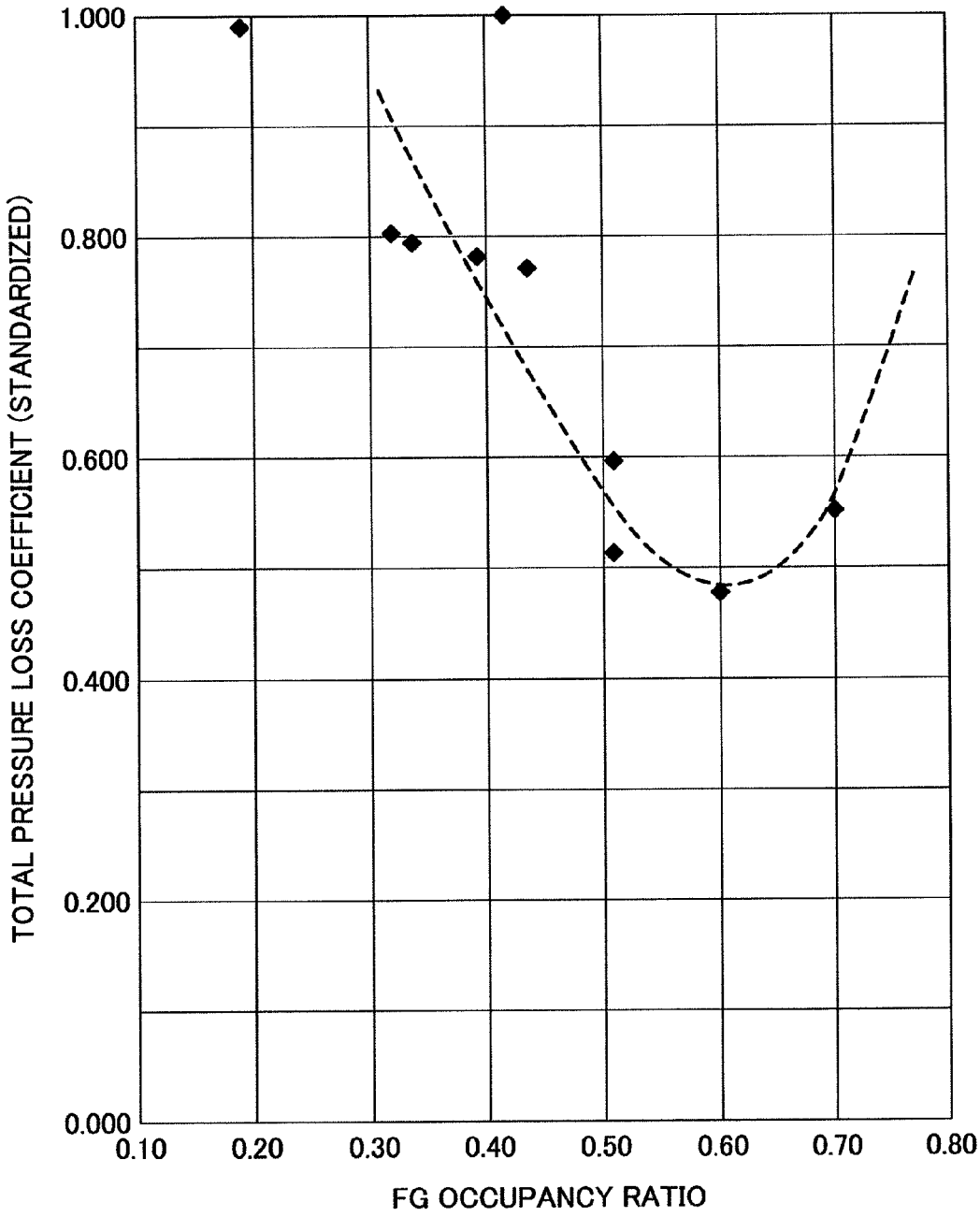
FIG. 5 shows the results of a numerical analysis (analysis 1).

FIG. 5 shows the results of analysis 1. The horizontal axis represents a flow guide occupancy ratio and the vertical axis represents a total pressure loss coefficient. The total pressure loss coefficient values shown in the figure were standardized based on the maximum value (each value/maximum value).

A flow guide occupancy ratio is an important concept of the present embodiment and will be described in more detail below.

Figure 6:
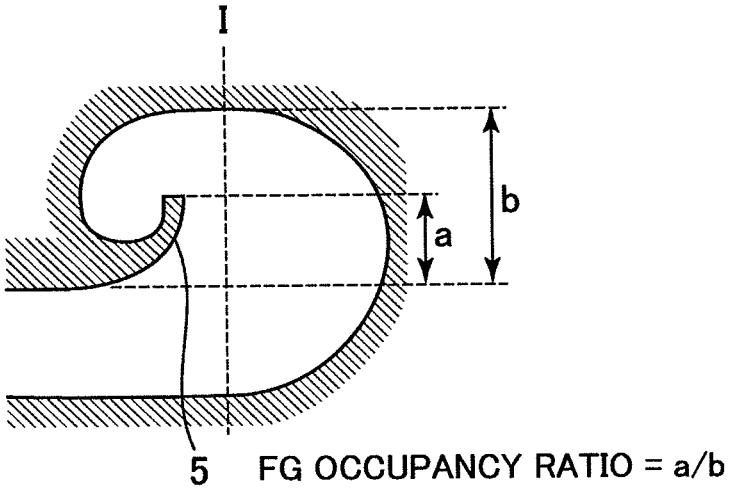
FIG. 6 is an enlarged longitudinal cross-sectional view of the exhaust hood.
Figure 7:
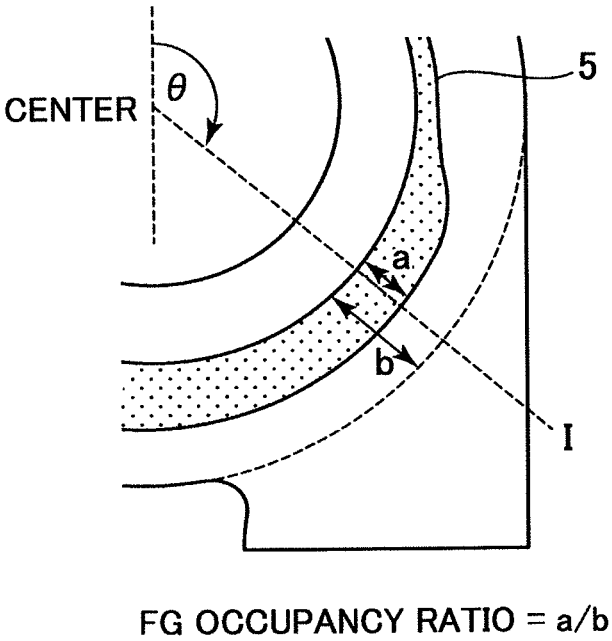
FIG. 7 is an enlarged transverse cross-sectional view of the exhaust hood.

FIG. 6 is an enlarged longitudinal cross-sectional view of the exhaust hood for assistance in explaining the flow guide occupancy ratio. FIG. 7 is an enlarged transverse cross-sectional view of the exhaust hood.

Referring to FIG. 7, an imaginary line "I" is drawn radially from the center of the rotor. In FIG. 6, a distance projected on the imaginary line "I", from the root portion of the flow guide to the leading end of the same is defined as a first distance "a". A distance projected on the imaginary line "I", from the root portion of the flow guide to the inner wall surface of the outer casing 1 is defined as a second distance "b". Further, a ratio (a/b) of the first distance to the second distance is defined as the flow guide occupancy ratio. In other words, the flow guide occupancy ratio can be said to be an index indicating the length of the flow guide.

Although the outer casing 1 is discontinuous at joint portions of the exhaust hood 12 and the exhaust duct 13, the inner wall surface of the outer casing 1 in FIG. 7 is treated to have a circular shape including a broken-line arc (imaginary inner wall surface). The second distance "b" is thus treated as a constant value.

A total pressure loss coefficient is an index indicating a pressure loss represented by the following formula: (exhaust hood inlet total pressure−exhaust hood outlet total pressure)/exhaust hood inlet dynamic pressure. The smaller the total pressure loss coefficient is, the more the pressure loss can be reduced preferably. As mentioned, total pressure loss coefficient values shown in FIG. 5 are standardized.

Returning to FIG. 5, the results of the analysis is explained. At a flow guide occupancy ratio of 0.3 to 0.5, the length of the flow guide is short and a sufficient rectification effect cannot be obtained. At a flow guide occupancy ratio of approximately 0.5 to 0.7, the mixing of a flow can be prevented to reduce a pressure loss. At a flow guide occupancy ratio of over 0.7, the flow passage is blocked, which causes the pressure loss to increase adversely. Consequently, an optimum flow guide occupancy ratio of the vertically symmetric flow guide 5A according to the conventional technology can be determined as 0.6 (total pressure loss efficiency 0.48).

Next, taking the optimum value 0.48 of the conventional technology as a reference value, a shape of the flow guide 5 that has a lower total pressure loss coefficient than the reference value was examined (analysis 2).

Figure 8:
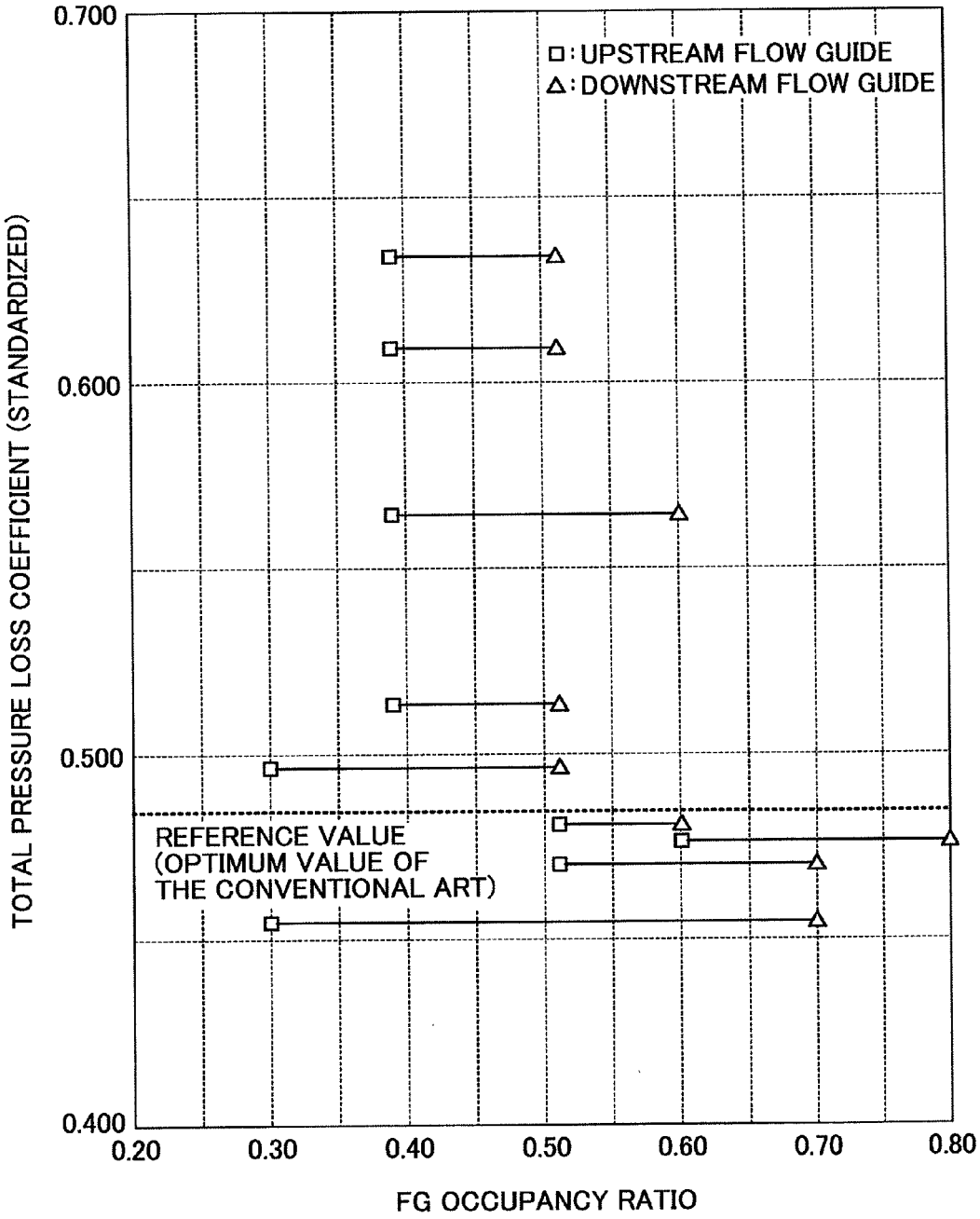
FIG. 8 shows the results of a numerical analysis (analysis 2).

FIG. 8 shows the results of analysis 2. The horizontal axis represents a flow guide occupancy ratio and the vertical axis represents a total pressure loss coefficient (standardized values as with FIG. 5). The reference value is additionally drawn. The flow guide occupancy ratio is expressed with a pair of symbols connected by a straight line; the symbols each represent the upstream flow guide portion 5*u* and the corresponding downstream flow guide portion 5*d*.

In analysis 2, the upstream flow guide portion 5*u* and the downstream flow guide portion 5*d* are defined as below. Referring to FIG. 7, assuming the side opposite to the exhaust duct 13 as θ=0, positions on the flow guide 5 are expressed by using a circumferential angle θ. The upstream flow guide portion 5*u* is the part where θ ranges approximately from 0 to 80°, and the downstream flow guide portion 5*d* is the part where θ ranges approximately from 100 to 180° (bilaterally symmetric).

Returning to FIG. 8, analysis results are described. When the flow guide occupancy ratio of the downstream flow guide portion 5*d* is less than 0.6, regardless of the flow guide occupancy ratio of the upstream flow guide portion 5*u*, the total pressure loss coefficient will not be lower than the reference value. Therefore, the lower limit of the flow guide occupancy ratio of the downstream flow guide portion 5*d* is set at 0.6.

Next, cases where the flow guide occupancy ratio of the downstream flow guide portion 5*d* is 0.6 or larger are discussed. When the flow guide occupancy ratio of the downstream flow guide portion 5*d* is 0.7, the pressure loss can be further reduced. However, when the flow guide occupancy ratio of the downstream flow guide portion 5*d* is 0.8, the pressure loss slightly increases.

The above tendency can be considered to have resulted from the following reason. The downstream side of the exhaust hood 12 has less spatial restriction than that of the upstream side of the exhaust hood 12 since the joint portions with the exhaust duct 13 exists at the downstream side. Thus, the flow guide occupancy ratio of the downstream side can be increased, and rectification effect can be expected to improve. On the other hand, when the flow guide occupancy ratio exceeds 0.8, the flow passage is blocked so that the pressure loss is increased adversely. The upper limit of the flow guide occupancy ratio of the downstream flow guide portion 5*d* is preferably set at 0.7.

The flow guide occupancy ratio of the upstream flow guide portion 5*u* is next discussed. With reference to the results of analysis 1, the upper limit of the flow guide occupancy ratio of the upstream flow guide portion 5*u* is set at 0.6. Meanwhile as a result of analyses, when the flow guide occupancy ratio of the downstream flow guide portion 5*d* was within a range of 0.6 to 0.7 inclusive, the total pressure loss coefficient was below the reference value even when the flow guide occupancy ratio of the upstream flow guide portion 5*u* was at 0.3. The lower limit of the flow guide occupancy ratio of the upstream flow guide portion 5*u* is thus set at 0.3.

The shape of the flow guide 5 is designed according to the results of analyses 1 and 2.

Figure 9:
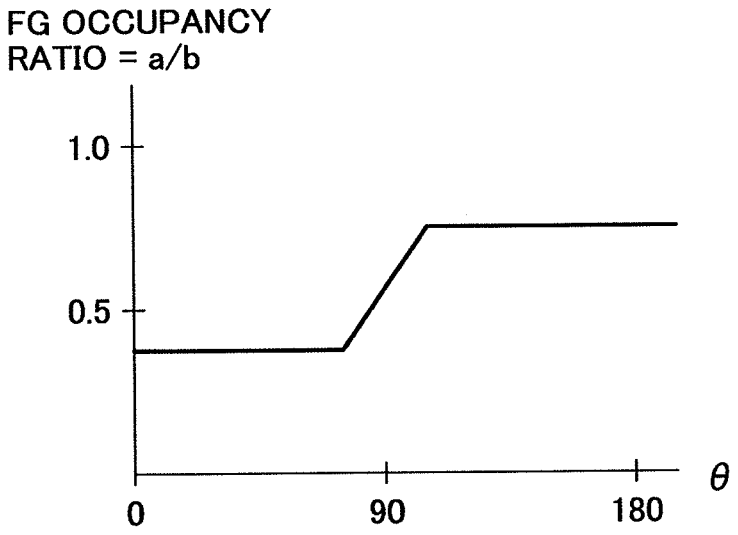
FIG. 9 shows an example of a shape of a flow guide designed based on the results of the numerical analyses (first embodiment).

FIG. 9 shows one example of a shape of the flow guide 5. The flow guide occupancy ratio of the upstream flow guide portion 5*u* (θ=0 to 80°) is set at 0.4, and the flow guide occupancy ratio of the downstream flow guide portion 5*d* (θ=100 to 180°) is set at 0.7. The flow guide occupancy ratio of the portion between them varies continuously from 0.4 to 0.7 with monotonic, moderate increase. A transverse cross-sectional view of such flow guide 5 is shown in FIG. 3.

Incidentally, the graph of the flow guide occupancy ratio was shown and described as if it is made from straight lines only. It is not to mention that the present invention is not limited to this.

—Effect—

While the flow guide 5A of the conventional technology had a vertically symmetric shape, the flow guide 5 of the present embodiment is modified to a vertically asymmetric shape wherein the length of the downstream flow guide portion 5*d* is longer than that of the upstream flow guide portion 5*u*. Further, by performing numerical analyses, the flow guide ratios of the upstream flow guide portion 5*u* and of the downstream flow guide portion 5*d* are set to fall within a range such that the total pressure loss coefficient becomes smaller than the optimum value of the conventional technology.

Adopting such configuration enhances rectification effect of the annular flow guide, which in turn reduces flow turbulence in the exhaust hood.

With the total pressure loss coefficient being suppressed lower than the optimum value of the conventional technology and the pressure loss being reduced, the turbine plant efficiency can be improved.

Second Embodiment

In the first embodiment, the portion of the flow guide with θ ranging from 100 to 180° was defined as the downstream flow guide portion 5*d* having a flow guide occupancy ratio of 0.7. Alternatively, the portion with θ ranging from approximately 100 to 150°, the area corresponding to the joint portion with the exhaust duct 13, may be set as a most-downstream flow guide portion 5*d*1. The flow guide occupancy ratio of the most-downstream flow guide portion 5*d*1 may be set at 0.7.

Figure 10:
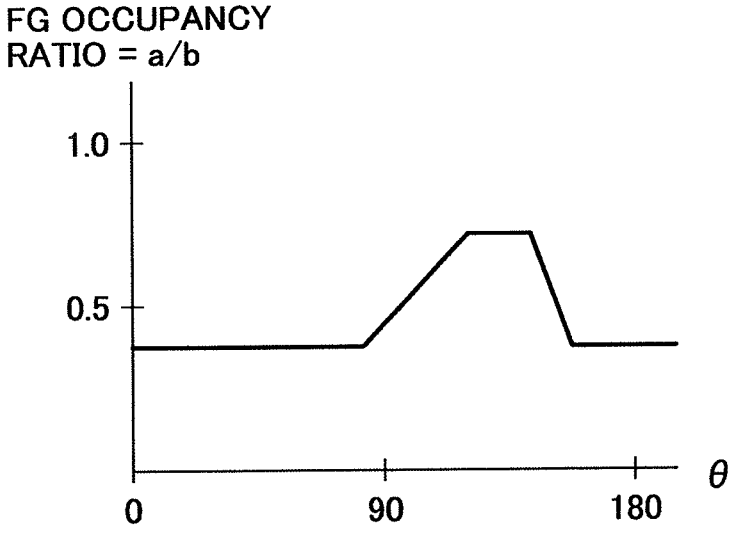
FIG. 10 illustrates an example of a shape of a flow guide designed based on the results of the numerical analyses (second embodiment).
Figure 11:
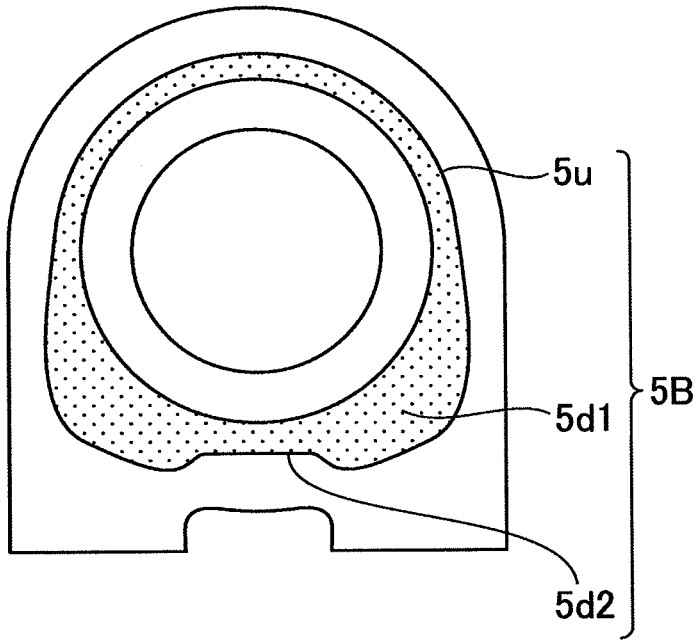
FIG. 11 is a transverse cross-sectional view illustrating a detailed configuration of the exhaust hood (second embodiment).

FIG. 10 is a graph showing an example of a shape of the flow guide 5B. The flow guide occupancy ratio of the upstream flow guide portion 5*u* (θ=0 to 80°) is set at 0.4 and that of the most-downstream flow guide portion 5*d*1 (θ=100 to 150°) is set at 0.7. The flow guide occupancy ratio of the downstream flow guide portion 5*d*2 (θ=170 to 180°) is set at 0.4 and that of the intervals (θ=80 to 100° and 150 to 170°) varies continuously between 0.4 and 0.7. A transverse cross-sectional view of such flow guide 5B is shown in FIG. 11.

The second embodiment can produce the same effect as that of the first embodiment as well.

Third Embodiment

The first and the second embodiments showed cases where the present invention is applied to an exhaust hood 12 having two exhaust ducts 13 at the downstream side. The present invention may also be applied to an exhaust hood 12 having one exhaust duct 13.

Figure 12:
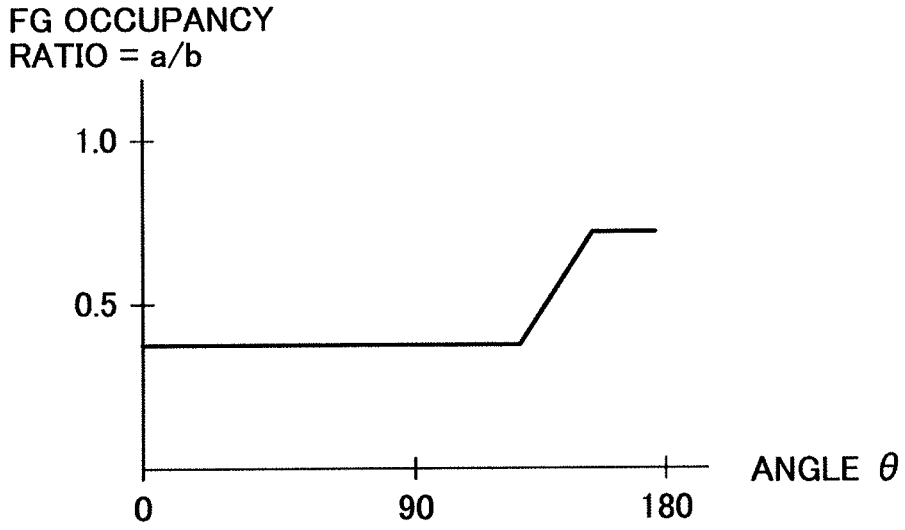
FIG. 12 illustrates an example of a shape of a flow guide designed on the basis of the results of the numerical analyses (third embodiment).
Figure 13:
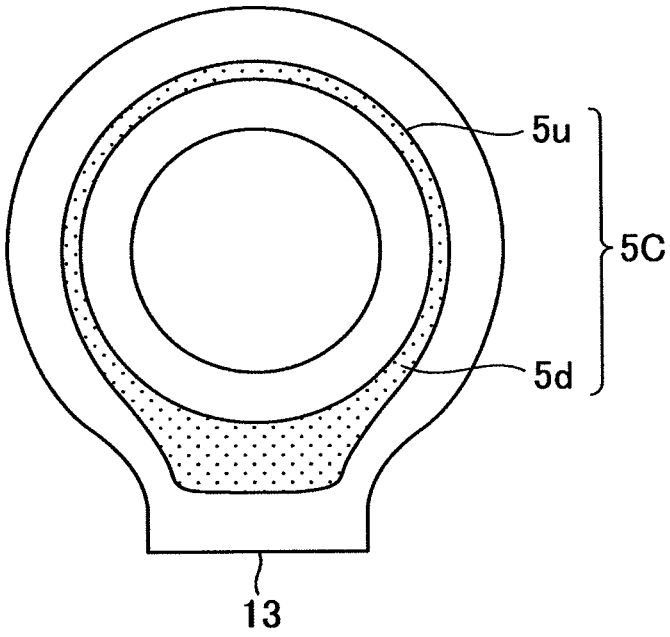
FIG. 13 is a transverse cross-sectional view illustrating a detailed configuration of the exhaust hood (third embodiment).

FIG. 12 is a graph showing an example of a shape of a flow guide 5C. The flow guide occupancy ratio of the upstream flow guide portion 5*u* (θ=0 to 120°) is set at 0.4 and that of the downstream flow guide portion 5*d* (θ=160 to)180° is set at 0.7. The flow guide occupancy ratio of the interval portion (θ=120 to 160°) between them varies continuously from 0.4 to 0.7. A transverse cross-sectional view of the flow guide 5C is shown in FIG. 13.

The third embodiment can also produce the same effect as that of the first embodiment.

Fourth Embodiment

Description for a bleed pipe 25 is omitted in the above for convenience sake of explanation. However, the present invention may be applied to an exhaust hood 12 including a bleed pipe 25. The flow guide of the fourth embodiment is a modification of the third embodiment that has the bleed pipe 25 connected at the side opposite to the exhaust duct 13.

Figure 14:
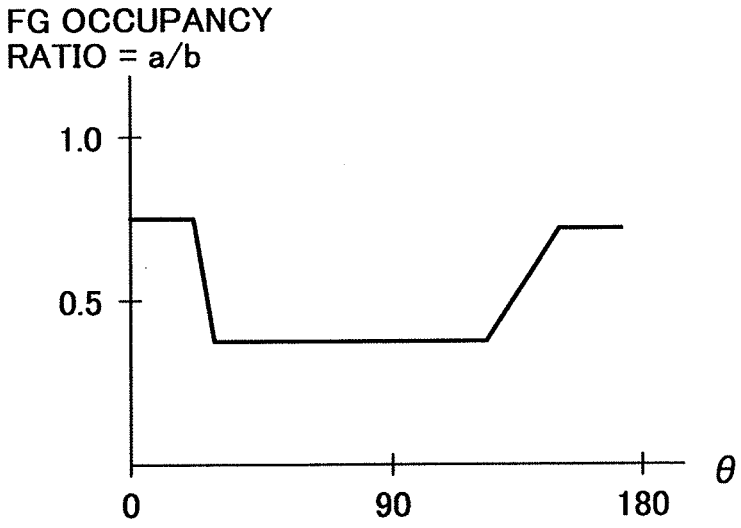
FIG. 14 illustrates an example of a shape of the flow guide designed on the basis of the results of the numerical analyses (fourth embodiment).
Figure 15:
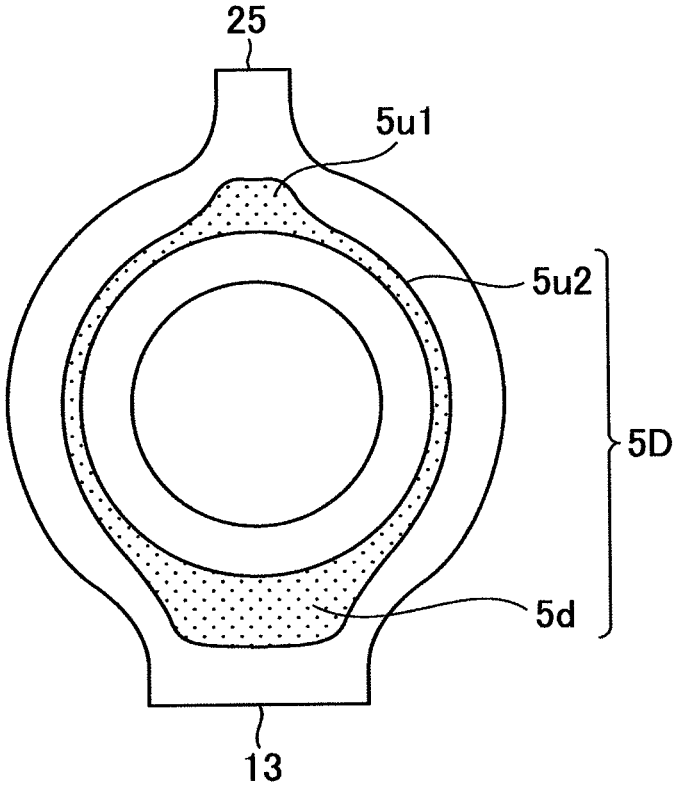
FIG. 15 is a transverse cross-sectional view illustrating a detailed configuration of the exhaust hood (fourth embodiment).

FIG. 14 is a graph showing an example of a shape of a flow guide 5D. The flow guide occupancy ratio of the most-upstream flow guide portion 5*u*1 (θ=0 to 10°) is set at 0.7 and that of the upstream flow guide portion 5*u*2 (θ=30 to) 120° is set at 0.4. The flow guide occupancy ratio of the downstream flow guide portion 5*d* (θ=160 to 180°) is set at 0.7 and the intervals (θ=10 to 30° and 120 to 160°) between them varies continuously between 0.4 and 0.7. A transverse cross-sectional view of the flow guide 5D is shown in FIG. 15.

The fourth embodiment can also produce the same effect as that of the first embodiment.

What is claimed is:

1. An exhaust system for a steam turbine that guides exhaust gas used to drive a high pressure turbine or an intermediate turbine to a downstream turbine via an exhaust duct, the system comprising:

an exhaust hood inner casing enclosing a turbine rotor;

an exhaust hood outer casing surrounding the exhaust hood inner casing to define an exhaust hood therebetween; and an annular flow guide installed downstream of last stage rotor blades which are fixed to the turbine rotor, the annular flow guide being installed continuously with an outer circumference of the exhaust hood inner casing, wherein the flow guide includes a downstream flow guide portion at the side of the exhaust duct and an upstream flow guide portion at the side opposite to the exhaust duct, the two portions being formed so that the downstream flow guide portion has a greater length than the upstream flow guide portion, when an imaginary line is drawn radially from the center of the rotor on a cross-section perpendicular to a rotor axis, the distance between a root portion of the flow guide and a leading end of the same is defined as a first distance, and the distance between the root portion of the flow guide and an inner wall surface of the exhaust hood outer casing is defined as a second distance, the ratio of the first distance to the second distance is defined as a flow guide occupancy ratio, the flow guide is formed so that the downstream flow guide portion has a greater flow guide occupancy ratio than the upstream flow guide portion, the flow guide occupancy ratio of the downstream flow guide portion is between 0.6 and 0.7 inclusive, and the flow guide occupancy ratio of the upstream flow guide portion is between 0.3 and 0.6 inclusive.

2. The exhaust system for a steam turbine according to claim 1, wherein a flow guide occupancy ratio between the downstream flow guide portion and the upstream flow guide portion is continuous.

3. An exhaust system for a steam turbine that guides exhaust gas used to drive a high pressure turbine or an intermediate turbine to a downstream turbine via an exhaust duct, the system comprising:

an exhaust hood inner casing enclosing a turbine rotor;

an exhaust hood outer casing surrounding the exhaust hood inner casing to define an exhaust hood therebetween; and an annular flow guide installed downstream of last stage rotor blades which are fixed to the turbine rotor, the annular flow guide being installed continuously with an outer circumference of the exhaust hood inner casing, wherein the flow guide includes a downstream flow guide portion at the side of the exhaust duct and an upstream flow guide portion at the side opposite to the exhaust duct, the two portions being formed so that the downstream flow guide portion has a greater length than the upstream flow guide portion, when an imaginary line is drawn radially from the center of the rotor on a cross-section perpendicular to a rotor axis, the distance between a root portion of the flow guide and a leading end of the same is defined as a first distance, and the distance between the root portion of the flow guide and an inner wall surface of the exhaust hood outer casing is defined as a second distance, the ratio of the first distance to the second distance is defined as a flow guide occupancy ratio, the flow guide is formed so that the downstream flow guide portion has a greater flow guide occupancy ratio than the upstream flow guide portion, the flow guide occupancy ratio of the downstream flow guide portion is between 0.6 and 0.7 inclusive, and the flow guide occupancy ratio of the upstream flow guide portion is between 0.5 and 0.6 inclusive.

* * * * *